US007413225B2

(12) United States Patent
Spurr

(10) Patent No.: US 7,413,225 B2
(45) **Date of Patent: *Aug. 19, 2008**

(54) LATCH MECHANISM WITH ENVIRONMENTALLY PROTECTED PORTION

(75) Inventor: Nigel V. Spurr, Shirley (GB)

(73) Assignee: Meritor Technology Inc., Troy, MI (US)

( * ) Notice: Subject to any disclaimer, the term of this patent is extended or adjusted under 35 U.S.C. 154(b) by 376 days.

This patent is subject to a terminal disclaimer.

(21) Appl. No.: 10/914,431

(22) Filed: Aug. 9, 2004

(65) Prior Publication Data

US 2005/0140146 A1 Jun. 30, 2005

(30) Foreign Application Priority Data

Dec. 31, 2003 (GB) ..... 0330263.5

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS

| | | | | |
|---|---|---|---|---|
| 709,607 | A | 9/1902 | Podlesak | |
| 2,174,078 | A * | 9/1939 | Burgin | 292/332 |
| 2,881,021 | A * | 4/1959 | Jacobson | 292/229 |
| 3,386,761 | A | 6/1968 | Johnstone et al. | |
| 4,518,180 | A | 5/1985 | Kleefeldt et al. | |
| 4,756,563 | A | 7/1988 | Garwood et al. | |
| 4,783,102 | A | 11/1988 | Bernard | |
| 4,824,152 | A | 4/1989 | Jeavons | |
| 4,838,588 | A | 6/1989 | Hayakawa et al. | |
| 4,948,184 | A * | 8/1990 | Weyerstall et al. | 292/216 |
| 4,978,153 | A * | 12/1990 | Hirsch et al. | 292/201 |
| 4,988,135 | A | 1/1991 | Ottino | |
| 5,092,639 | A | 3/1992 | Di Giusto | |
| 5,127,686 | A * | 7/1992 | Gleason et al. | 292/216 |
| 5,188,406 | A | 2/1993 | Sterzenbach et al. | |
| 5,309,745 | A * | 5/1994 | Ursel et al. | 70/264 |
| 5,603,539 | A * | 2/1997 | Gruhn et al. | 292/216 |
| 6,059,327 | A * | 5/2000 | Yoshikuwa | 292/216 |
| 6,457,753 | B1 * | 10/2002 | Wegge | 292/216 |
| 6,497,436 | B1 * | 12/2002 | DeBlock et al. | 292/216 |
| 6,540,272 | B2 * | 4/2003 | Spurr | 292/216 |
| 6,601,883 | B1 * | 8/2003 | Kalsi | 292/216 |
| 2004/0056489 | A1 | 3/2004 | Boecker et al. | |
| 2004/0227358 | A1 | 11/2004 | Kachouh | |
| 2004/0239124 | A1 * | 12/2004 | Larsen et al. | 292/201 |

FOREIGN PATENT DOCUMENTS

| | | |
|---|---|---|
| DE | 3414475 | 12/1985 |
| DE | 3934982 | * 5/1990 |
| DE | 9012785 | 1/1991 |

(Continued)

*Primary Examiner*—Carlos Lugo
(74) *Attorney, Agent, or Firm*—Carlson, Gaskey & Olds

(57) ABSTRACT

A latch mechanism includes a latch plate and a latching element attached to the latch plate. A pawl engages the latching element at an interface. Applying a force to the pawl releases the latch mechanism. The latch mechanism also includes an enclosure for enclosing a portion of the latching mechanism.

15 Claims, 12 Drawing Sheets

FOREIGN PATENT DOCUMENTS

| | | | |
|---|---|---|---|
| DE | 10214691 | | 10/2003 |
| EP | 0978609 | A1 | 2/2000 |
| FR | 2828517 | | 2/2003 |
| GB | 785729 | | 11/1957 |
| GB | 2401145 | | 11/2004 |

* cited by examiner

F resulting from P of 100 and increasing toggle offset (C)

LATCH MECHANISM WITH ENVIRONMENTALLY PROTECTED PORTION

This application claims priority to Great Britain Application No. 0330263.5 filed on Dec. 31, 2003 which is incorporated herein by reference.

FIELD OF THE INVENTION

The present invention relates to a latch mechanism, and in particular, to a latch mechanism with an environmentally protected portion.

BACKGROUND OF THE INVENTION

A latch mechanism includes a claw and a striker. The claw is rotatably attached to a latch retention plate. The latch retention plate is attached to a first object. The striker is attached to a second object. The claw is rotatably attached to the latch retention plate. Moving the striker into the claw rotates claw from an unlatched position to a latched position. In the latched position, the claw encloses the striker. A pawl is rotatably attached to the latch retention plate. The pawl engages the claw to maintain the claw in the closed position. To move the claw from a latched position to an unlatched position with respect to the striker requires disengaging the pawl from the claw by applying a selected release force to the pawl. Applying the selected release force to the pawl disengages the pawl from the claw and allows the claw to rotate when an opening force is applied to the second object having the attached striker. The selected release force between the pawl and the claw can be increased significantly when the pawl and claw operate in an unclean environment. The release force between the pawl and claw is dependent on the coefficient of friction between the claw and pawl engaging surfaces. When dust, corrosion, or salt contaminate the interface between the claw and the pawl, the release force increases which substantially increases the effort needed to release the latching mechanism.

SUMMARY OF THE INVENTION

The latch mechanism also includes a primary biasing element that applies a biasing force to the primary pawl. The latch mechanism further includes a fixed pin attached to the latch plate. A surface of the primary pawl rides on the fixed pin. The latch mechanism also includes a secondary biasing element that applies a biasing force to the secondary pawl. The latch mechanism further includes a stop positioned to limit the motion of the claw with respect to the toggle link. The pivot point of the primary pawl is offset from a line between the pivot point of the toggle link and the point on the toggle link where the secondary pawl engages the toggle link. The claw further includes a first surface for engaging the primary pawl, and a second surface for engaging the primary pawl.

The latch mechanism also includes a primary biasing element that applies a biasing force to the primary pawl. The latch mechanism further includes a fixed pin attached to the latch plate. A surface of the primary pawl rides on the fixed pin. The latch mechanism also includes a secondary biasing element that applies a biasing force to the secondary pawl. The latch mechanism further includes a stop positioned to limit the motion of the claw with respect to the toggle link. The pivot point of the primary pawl is offset from a line between the pivot point of the toggle link and the point on the toggle link where the secondary pawl engages the toggle link.

The claw further includes a first surface for engaging the primary pawl, and a second surface for engaging the primary pawl.

A method for controlling the release force of a latch mechanism includes holding a portion of the latch mechanism in place with a pawl, and controlling ingress of contaminates at an interface between the pawl and a portion of the latch mechanism. Controlling ingress of contaminates includes enclosing a portion of the latch mechanism and a portion of the pawl to inhibit contamination at an interface between the pawl and a portion of the latch mechanism. In one embodiment, enclosing a portion of the latch mechanism and a portion of the pawl to inhibit contamination at an interface between the pawl and a portion of the latch mechanism includes enclosing the entire pawl. In one embodiment, the pawl having an enclosed portion that interacts with a portion of the latching mechanism other than a claw. In some embodiments, enclosing a portion of the pawl and a portion of the latching mechanism includes substantially sealing an opening through which a portion of the pawl or a portion of the locking mechanism extends.

A latch mechanism includes a latch plate, a latching element attached to the latch plate, and a pawl engaging the first latching element at an interface. Applying a force to the pawl releases the latch mechanism. The latch mechanism also includes an enclosure for enclosing the interface between the pawl and the latching element.

DETAILED DESCRIPTION OF THE INVENTION

In the following description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
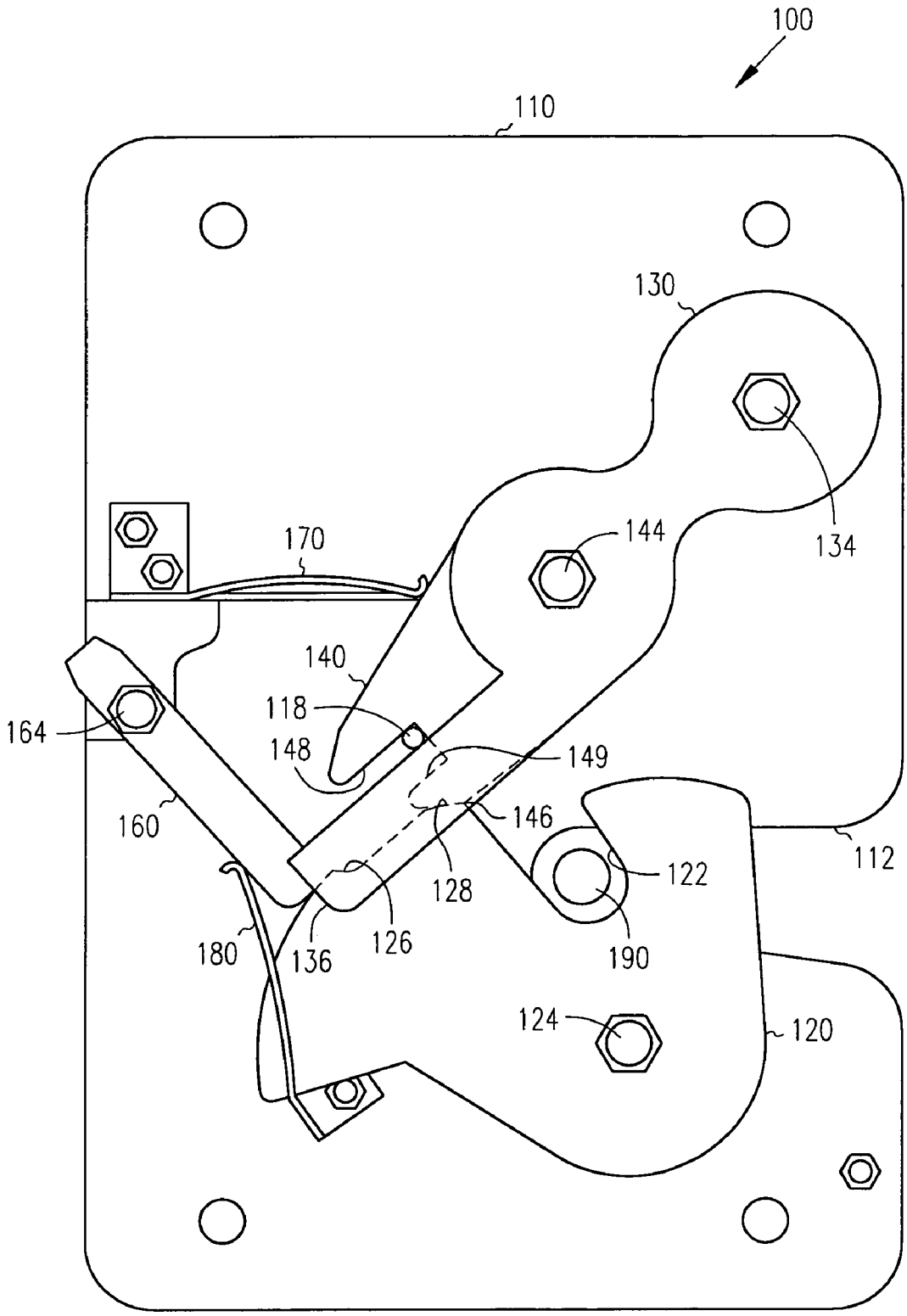
FIG. 1 is a perspective of a latch mechanism according to an embodiment of the invention.

FIG. 1 is a perspective view of a latch mechanism 100, according to an embodiment of this invention. The latch mechanism 100 latches to a pin called a striker 190. The latch mechanism 100 includes a latch plate 110 that is associated with a first object. Generally the latch plate 110 is fixedly attached to the first object. The latch plate includes an opening or slot 112 sized to receive the striker 190 associated with a second body. The latch mechanism 100 also includes a claw 120 rotatably attached to the latch plate at a pivot point 124. The claw 120 also has an opening or slot 122 therein. The claw 120 is positioned on the latch plate 110 so that the opening or slot 122 therein aligns with the opening or slot 112 when the latch mechanism 100 is in an open position. Moving the striker (shown in FIG. 5) into the slot 122 of the claw 120 causes the claw 120 to rotate so that the claw 120 surrounds the striker 190 by the time the striker 190 travels down the length of the slot 112 in the latch plate 110. A toggle link 130 is rotatably attached to the latch plate 110 at a pivot point 144. The primary pawl 140 includes a surface 146 that retains the claw 120. The claw 120 has a first pawl catch surface 126 and a second pawl catch surface 128.

A secondary pawl 160 is rotatably attached to the latch plate 110 at a pivot point 164. The secondary pawl 160 interacts with the toggle link 130 to retain it in a selected position As shown in FIG. 1, the secondary pawl 160 interacts with a free end 136 of the toggle link 130 The latch mechanism 100 also includes a primary biasing element 170 that applies a biasing force to the primary pawl 140. In one embodiment, the primary biasing element 140 is a spring. The latch mechanism further includes a fixed protrusion or pin 118. In one embodiment, the fixed protrusion or pin is attached to the latch plate 110. A surface of the primary pawl 148 rides on the fixed pin 118 as the primary pawl 140 moves during latching and unlatching. The primary biasing element 170 biases the surface 148 of the primary pawl 140 onto the pin 118. The latch mechanism 100 also includes a secondary biasing element 180 that applies a biasing force to the secondary pawl 160. In one embodiment, the secondary biasing element 180 is a spring. In one embodiment, the latch mechanism 100 further includes a stop positioned to limit the motion of the claw 120 with respect to the toggle link 130. The primary pawl 140 includes a stop surface 149. The pivot point 144 of the primary pawl 140 is offset from a line between the pivot point 134 of the toggle link 130 and the point on the toggle link 130 where the secondary pawl 160 engages the toggle link 130. The claw 120 further includes a pawl catch surface 126 for engaging the primary pawl 140, and a pawl catch surface 128 for engaging the primary pawl 140. The slot 122 of the claw 120 acts as a cam surface. When a closing force is applied tot the striker thereby moving the striker into the slot 112 of the latch plate 110, the striker rides over the cam surface associated with the slot 122 causing the claw to move from an open position to a closed position. In the closed position, the claw 120 and specifically the slot 122 surrounds the striker190.

Figure 2:
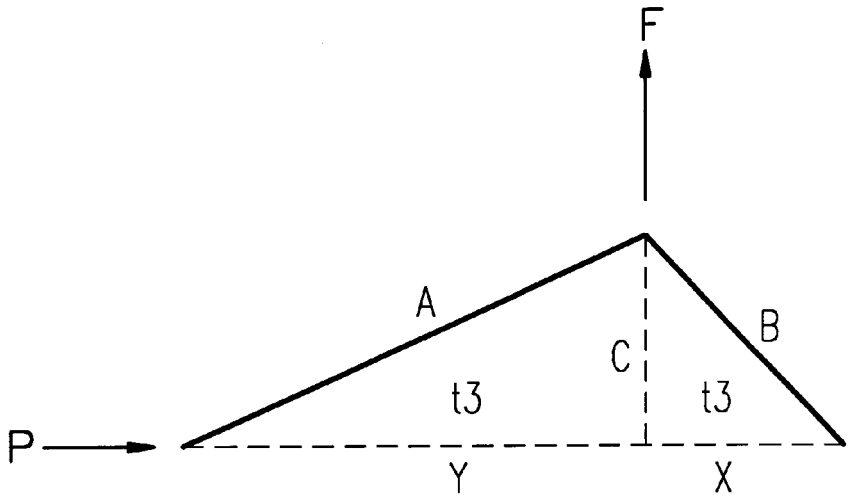
FIG. 2 is a schematic diagram of a toggle joint, according to an embodiment of the invention.
Figure 3:
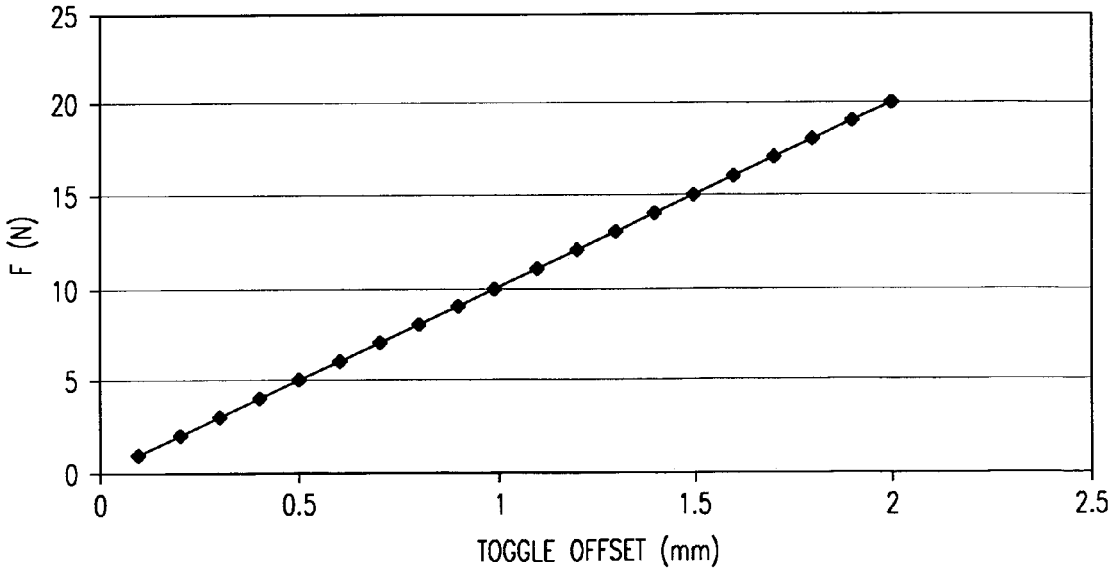
FIG. 3 is a chart of the toggle link offset against the force at a secondary pawl, according to an embodiment of the invention.
Figure 13:
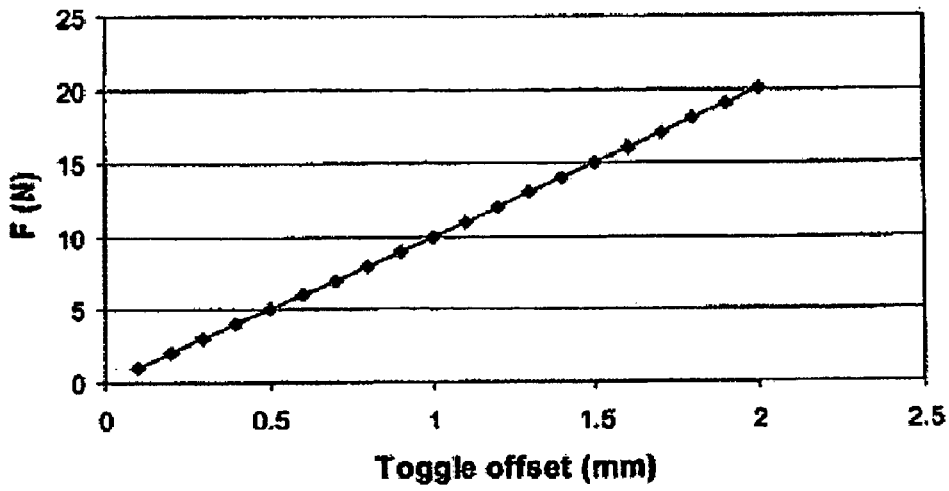

The latching mechanism 100 employs a toggle joint formed by the portion of the toggle link 130 between the pivot point 134 and the pivot point 144, and the portion of the primary pawl 140 between the pivot point 133 and the primary pawl surface 146 that catches the catch surface 126 or the catch surface 128 of the claw 120. The toggle joint formed can be represented by the schematic figure shown in FIG. 2. Line segment A corresponds to the portion of the toggle line 130 between pivot points 134 and 144. Line segment B corresponds to the portion of the primary pawl 140 between the pivot point 144 and the primary pawl surface 146 that catches the catch surface 126 or the catch surface 128 of the claw 120. The reaction force F is a fraction of the applied force P. The ratio of the forces F/P is dependant upon the toggle line length A and B and offset distance C. FIG 13 shows a chart that plots this relationship for a toggle having equal length links of 20mm. It is readily apparent that at small offsets, the value of F is a small faction of P.

The high ratio of F to P may be used to advantage in a latch system, such as the latch system 100 shown in FIG. 1. A load on the claw 130 of the latch mechanism 100 is represented by P. The toggle offset is restrained by a pawl, such as the secondary pawl 160, to which is applied a load of F. To cause the load P to be released, the pawl may be disengaged from the toggle, and the feature engaging with the load P, such as the primary pawl 140, is guided to cause it to disengage from the load P. The fixed pin 118 guides the primary pawl 140. The primary biasing element 170 forces the primary pawl 140 to ride over surface 148 of the primary pawl 140. In some embodiments, a stop also guides the primary pawl and restrains the movement of the primary pawl 140 and the toggle link 130. As shown in FIG. 1, the primary pawl 140 includes a stop surface 149.

Figure 4:
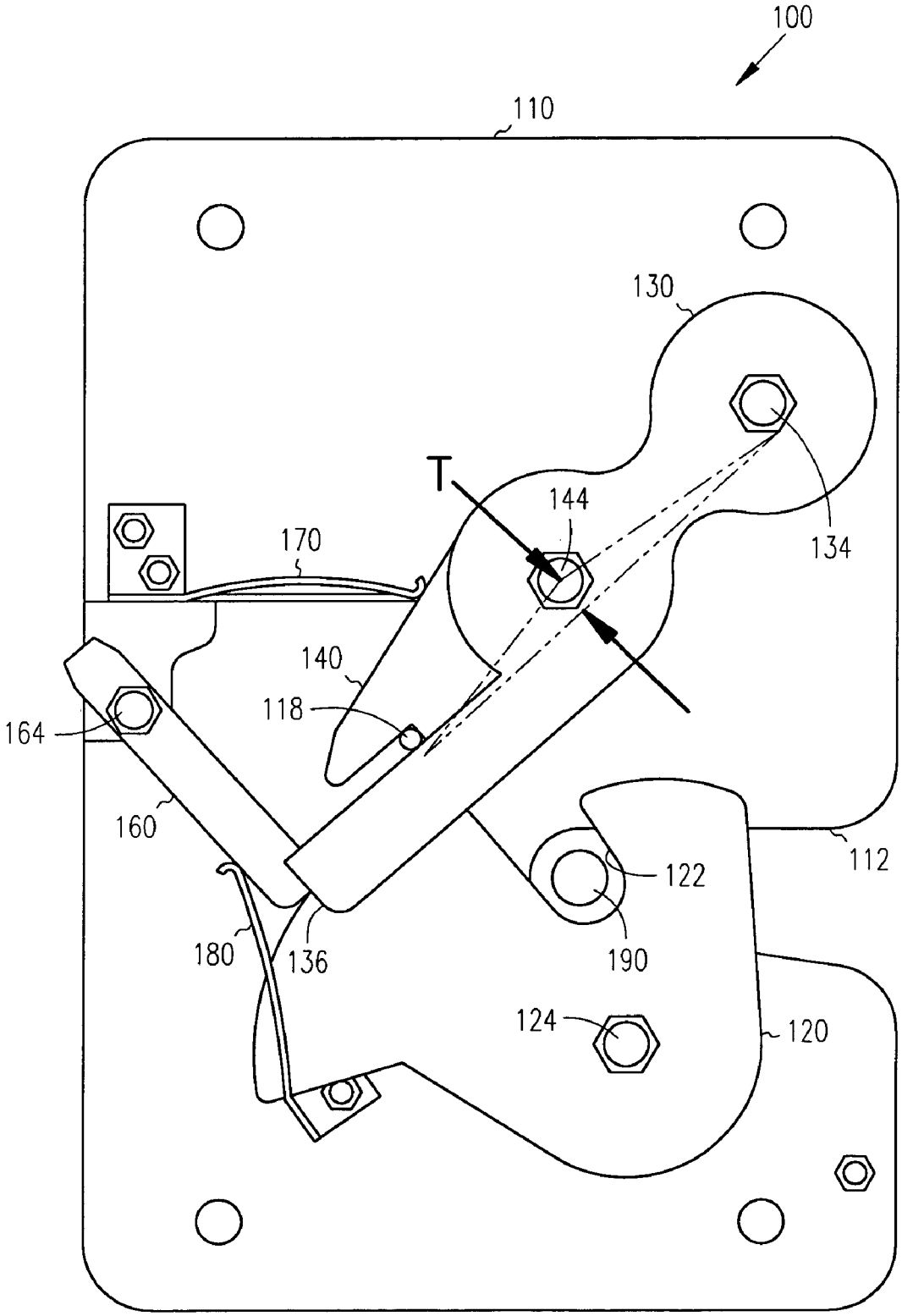
FIG. 4 is a top view of a latch mechanism in a closed position, according to an embodiment of this invention.

FIG. 4 is a top view of a latch mechanism 100 in a closed position, according to an embodiment of this invention. The pivot point 144 of the primary pawl 140 is the central fulcrum of the toggle joint formed. A load (P) placed upon the primary pawl 140 by the claw 120 is largely transferred to the fixed pivot point 134 via the toggle link 130. A torque is generated about the toggle link 130 fixed pivot point 134 as a result of the toggle offset (T). The toggle link 130 is prevented from rotating by the secondary pawl 160 thus ensuring that latch mechanism 100 remains in the latched position. The longer the distance or radius at which the secondary pawl 160 engages with the toggle link 130, the smaller the force needed to be applied by the secondary pawl 160 to hold the toggle link 130. By way of example, for the system shown, the work done to disengage the secondary pawl 160 from the toggle link 130 is 4.49 Nmm, compared with work done of 383 Nmm that would be necessary to release a pawl from the claw in a system without the toggle link 130 and secondary pawl 160. This is a reduction of a factor of 85 times. In other words, as shown, the force necessary to release the latch mechanism is $1/85^{th}$ the force previously required. Thus, using a toggle link 130 and a secondary pawl 160 allows for lower energy release mechanisms. It should be noted that the length between the fixed pivot point 134 of the toggle link 130 and the engagement point of the secondary pawl 160 can be changed to increase or decrease the mechanical advantage.

Figure 5:
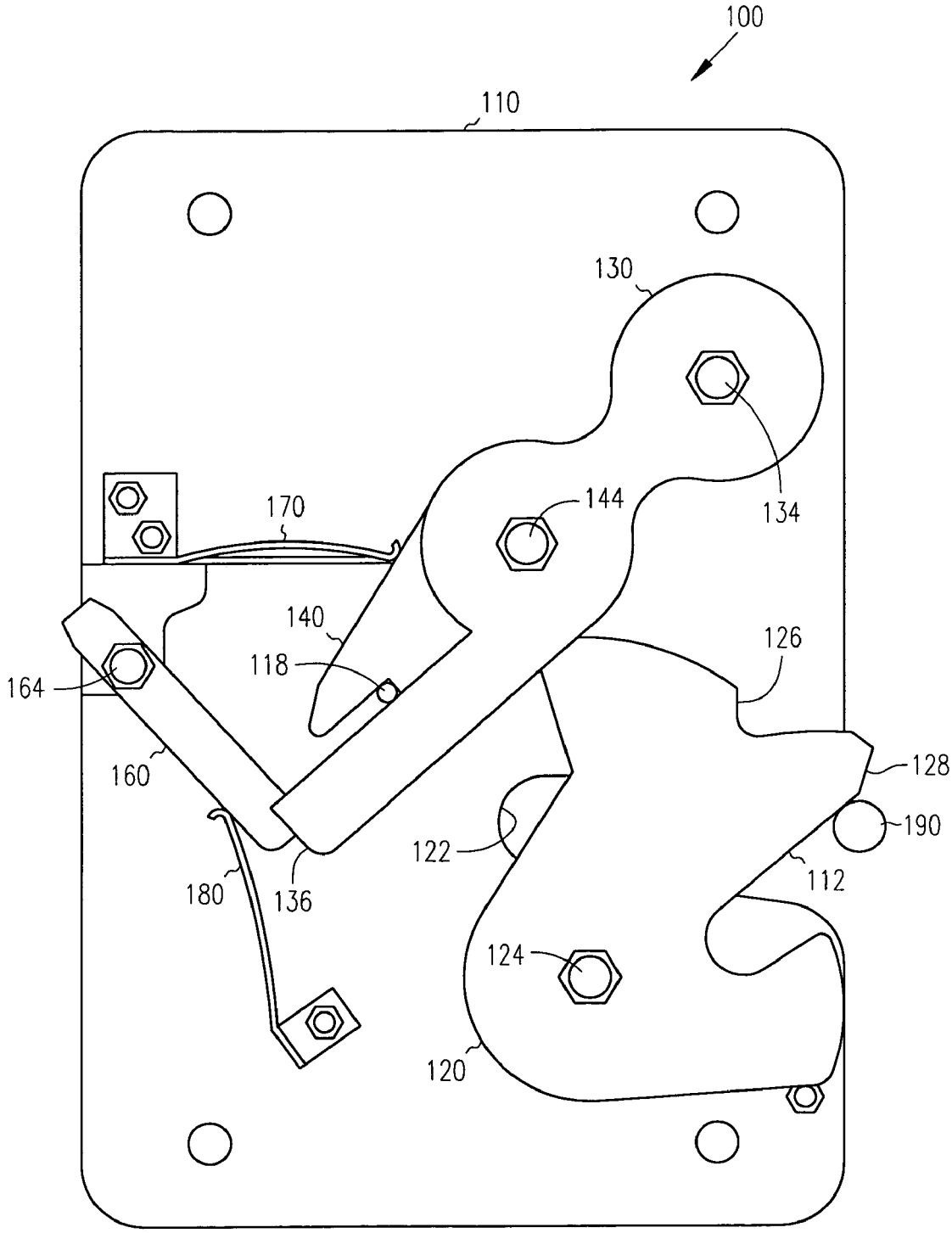
FIG. 5 is a top view of a latch mechanism with the claw in an open position and the secondary pawl engaged with the toggle link, according to an embodiment of this invention.

FIG. 5 is a top view of a latch mechanism with the claw 120 in an open position and the secondary link 160 engaged with the toggle link 130, according to an embodiment of this invention. The primary pawl 140 is free to rotate independently of the toggle link 130. The primary pawl 140 rotates about pivot point 144 as the striker is inserted into the slot 122 of the claw and into the slot 112 of the latching plate 110. As the striker 190 is moved inward, the claw 120 moves or rotates about the pivot point 124 from the open shown in FIG. 5 to a position where the claw 120 surrounds or captures the striker, as shown in FIG. 6.

Figure 6:
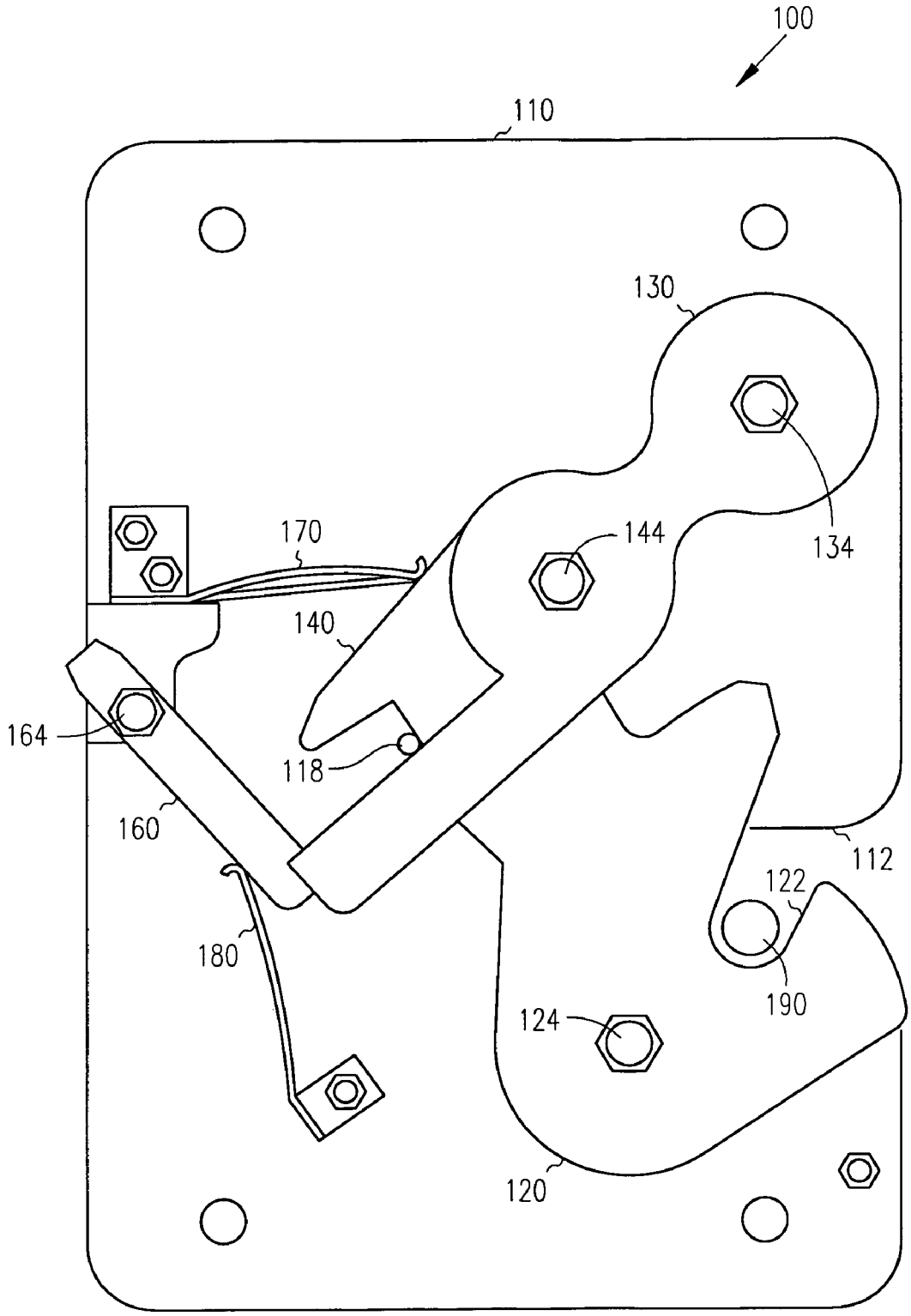
FIG. 6 is a top view of a latch mechanism with the claw in a position between open and a secondary latched position (latch part closed) with the secondary pawl engaged with the toggle link, according to an embodiment of this invention.

FIG. 6 is a top view of a latch mechanism with the claw 120 in a position with the secondary link 160 engaged with the toggle link 130, according to an embodiment of this invention. As the claw 120 latches to the striker, the claw 120 remains in a fixed position since the secondary pawl 160 remains engaged with the free end 136 of the toggle link 130. Once in the latched position, the primary pawl bias element 170 drives the primary pawl 140 into engagement with the claw 120. More specifically, the primary pawl surface 146 initially engages the pawl catch surface 126 and then engages the pawl catch surface 128 as the striker is fully inserted into the slot 112 of the latch plate 120. When fully inserted, the pawl catch surface 128 is engaged by the primary pawl 140 and the latch is fully closed (i.e. the latch is in its primary latched position). When the primary pawl surface 146 initially engages the pawl catch surface 126, the latch mechanism is in its secondary latched position (i.e. the latch is only part closed).

The primary pawl biasing element 170, shown as a leaf spring but which could be any spring type, has at least two functions. The first function is to engage the primary pawl 140 and claw 120. The second function is to drive the toggle link 130 into the rest position after the claw 120 fully releases the striker. When the toggle link 130 is in the rest position, the secondary pawl 160 engages the toggle link 130. This dual functionality is achieved, in this instance, by placing the primary biasing element 170 so that the force produced by the primary biasing element 170 is on the pawl and located between the pawl pivot 144 and the engaging radius of the primary pawl 140 and claw 120.

Figure 8:
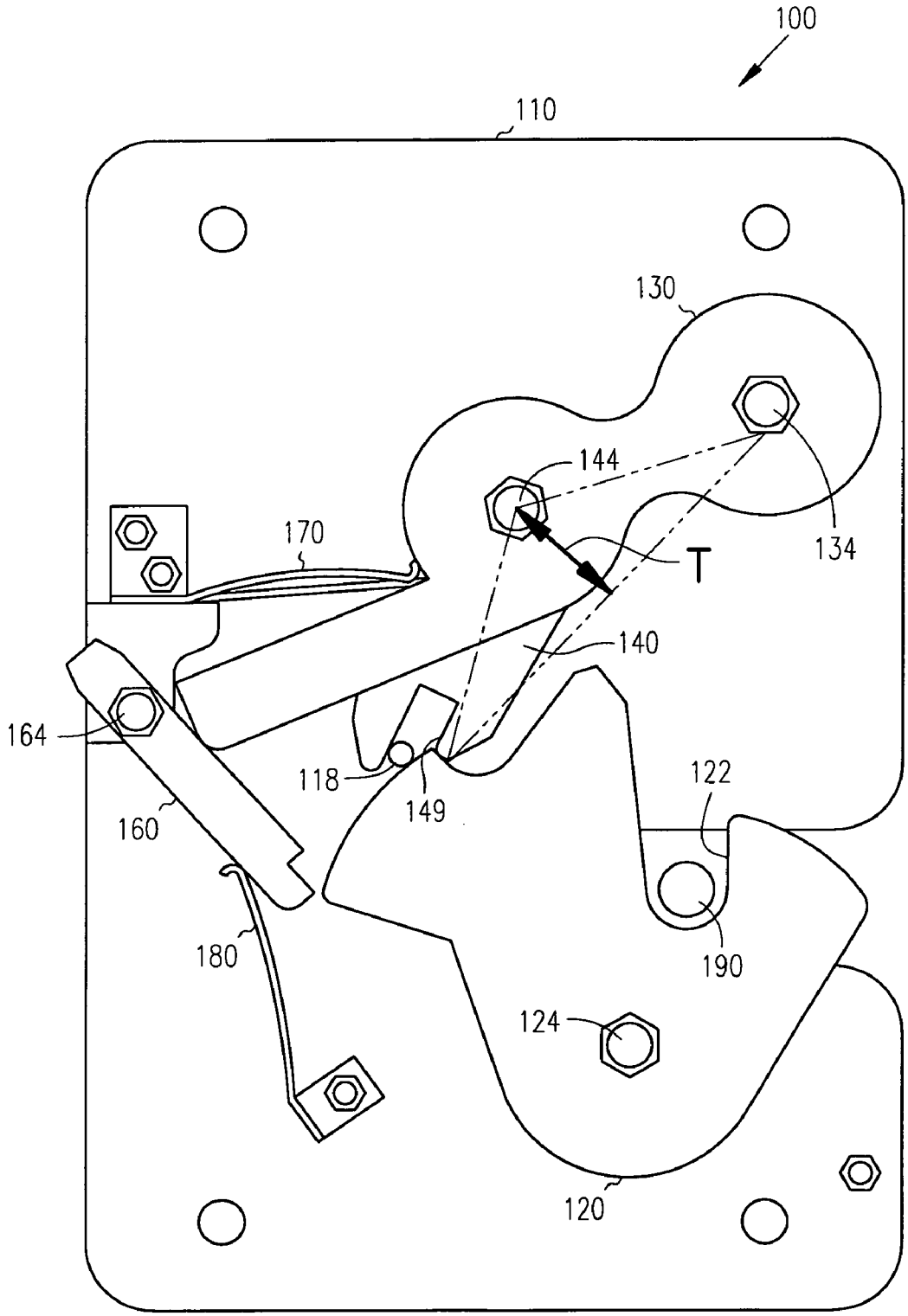
FIG. 8 is a perspective view of a latch mechanism as the claw is being unlatched with the secondary pawl disengaged from the toggle link, according to an embodiment of this invention.

FIG. 8 is a perspective view of the latch mechanism 100 as the claw 120 is being unlatched with the secondary pawl 160 disengaged from the toggle link 130, according to an embodiment of this invention When unlatching, the secondary pawl 160 is disengaged from the toggle link 130. The force applied to the primary pawl 140 by the claw 120 causes the toggle offset (T) to increase. In other words, the toggle link 130 buckles at the point of rotation 144. The amount of buckling is controlled by the primary biasing element 170, the fixed pin 118 attached to the latch plate 110, and the stop 149. The surface 148 of the primary pawl 140 contacts the fixed pin 118, in one embodiment, or the claw 120 in another embodiment. The fixed pin 118 acts as a pivot and directs the primary pawl 140 and claw 120 as the claw disengages from the striker. Once the claw 120 is open (where the slot 122 of the claw is substantially aligned with the slot 112 of the latch plate 110) and past the secondary latched position, no force is applied to the primary pawl 140. The biasing element 170, a leaf spring as shown in FIG. 8, moves the primary pawl 140, which in turn moves the toggle link 130 to the rest position. Once the toggle link 130 is in the rest position, the secondary pawl engages the free end 136 of the toggle link 130 (as shown previously in FIG. 5).

The latch mechanism 100 can be used in any application where a claw is used to hold a relatively large force and it is desired to use a smaller force to release the claw. Applications include railroad cars, doors of various types including vehicle doors, and the like. In one example application for a vehicle door, the force to cause the claw 120 to rotate and disengage the primary pawl 140 has been calculated as 37N with a typical pawl spring torque of 40 Nmm. This poses no problem when the latch mechanism 100 is closed against a seal force of at least 300N, but could be a problem if the user of the vehicle door is "playing around" with the latch mechanism. To overcome this concern, another embodiment includes an alternative engaging spring that acts between the primary pawl 140 and toggle link 130. When engaged with the secondary pawl 160, the spring will drive the primary pawl 140 into the latched position. The reaction force form this spring is configured to generate a torque about the toggle link 130, to cause it to move to the unlatched position when the secondary pawl 160 is disengaged, regardless of any force that is present on the primary pawl 140 from the claw 120. In the alternative embodiment of the latching mechanism, a device is required to use the motion generated in the claw 120 during closing from the open to first safety position, to move the toggle link 130 to the position where the secondary pawl 160 can engage.

Figure 7:
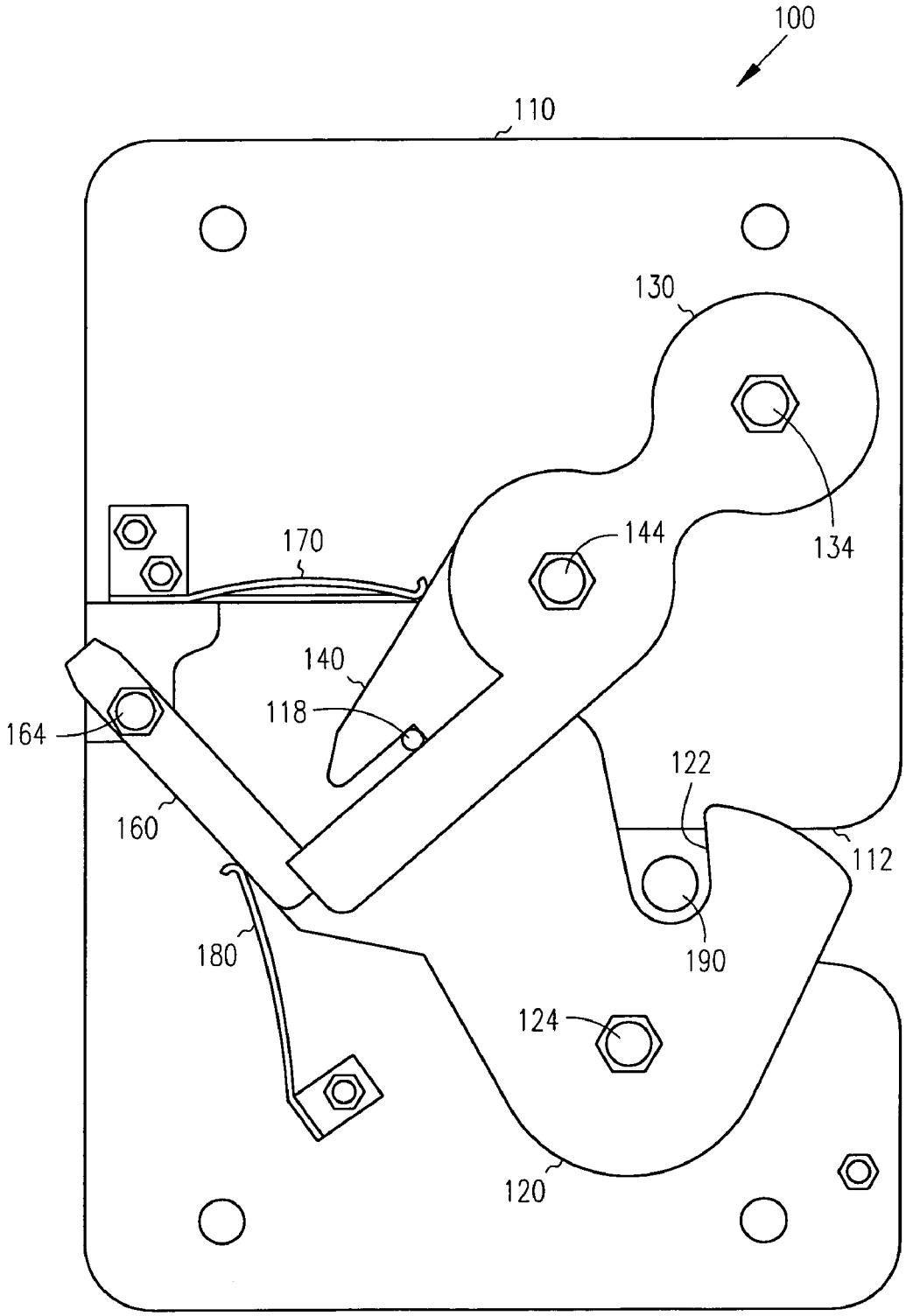
FIG. 7 is a top view of a latch mechanism with the claw in a secondary latched position (latch part closed) with the secondary pawl engaged with the toggle link, according to an embodiment of this invention. with the toggle link, according to an embodiment of this invention

From FIGS. 6 and 7 it is apparent that the primary pawl 140 and claw 120 engage with a primary and a secondary latching feature, as is required in many applications. Should the pawl and claw not be properly engaged in the primary latched position, the primary pawl 140 is free to engage in the secondary latched position independent of the toggle system 130. The secondary pawl biasing element 180 moves the toggle link 130 to its rest position where, with the mechanical clearance provided, the secondary pawl 160 engages the toggle link 130.

When a latch mechanism is to be used in a vehicle door, many times customers specify that latch mechanisms must not open with an applied deceleration of 30G in the vehicle transverse and longitudinal axis. Some customers specifications further require the latch mechanism to not open in the presence of 60 G decelerations along a vertical axis. To meet these specifications, mass of the latch mechanism 100 must be minimized and the components must be balanced. Within the latch system 100, the primary pawl 140 and the secondary pawl 160 are affected by the deceleration requirement. The primary pawl 140 and the secondary pawl 160 should be balanced about their respective pivot points 144, 164, respectively.

Figure 9:
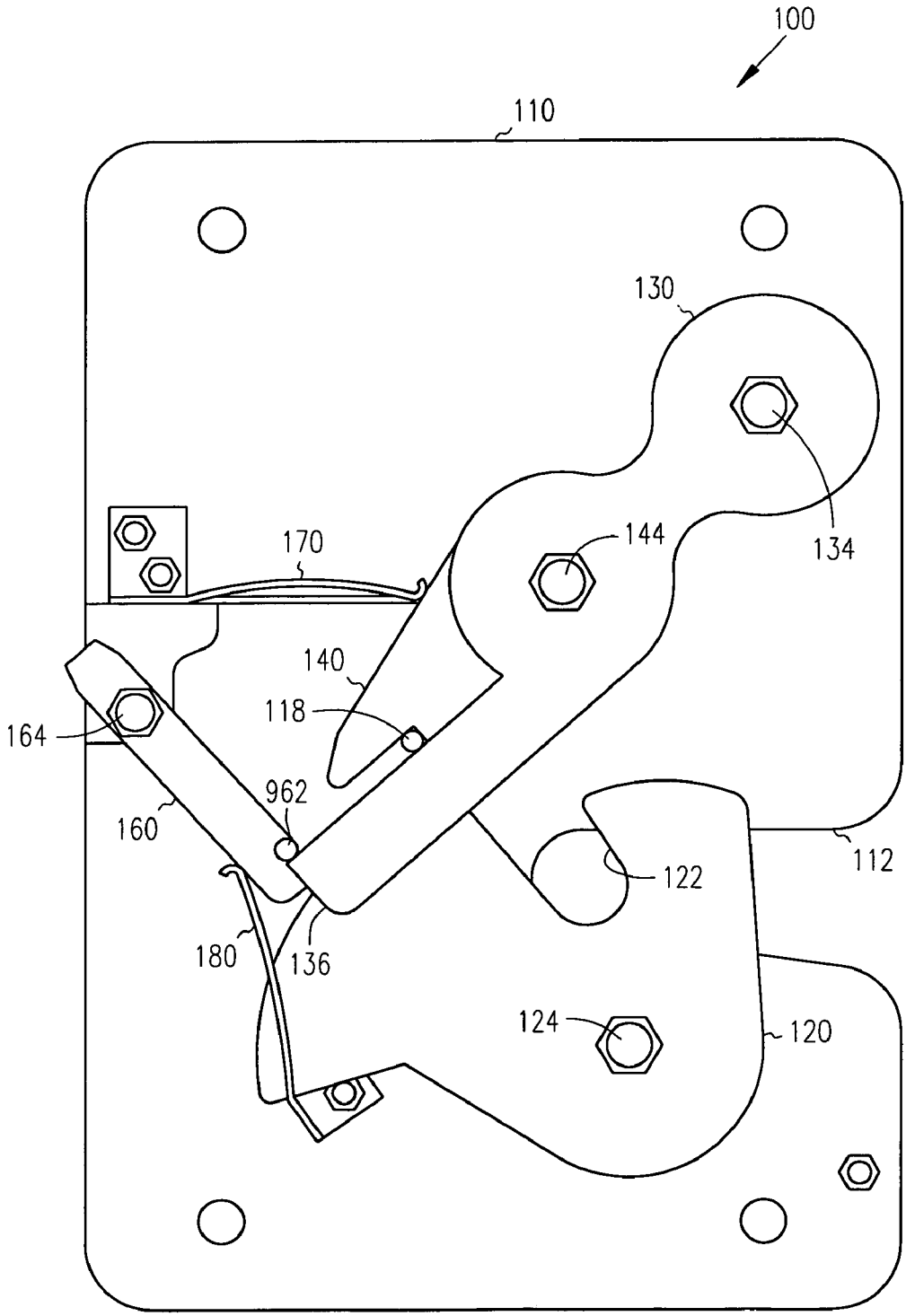
FIG. 9 is a top view of a latching mechanism that includes a roller on the secondary pawl according to an embodiment of this invention.

Due to the very significantly reduced loads applied to the secondary pawl 160 compared with the primary pawl 140, in some embodiments the work done to unlatch the latching mechanism is can be further reduced. FIG. 9 is a top view of a latching mechanism 900 according to an embodiment of this invention. The latching mechanism 900 is similar to the latching mechanism 100 shown and described above. The main difference between the latching mechanism 900 and the latching mechanism 100 will be described for the sake of clarity and brevity. The latching mechanism 900 includes a secondary pawl 960 that includes a roller 962 on the free end of the secondary pawl 960. The roller 962 engages the free end 136 of the toggle link 130. The roller 962 significantly reduces the torque required to move the secondary pawl 960 when compared to the latch mechanism 100 that has a direct contact between the secondary pawl 160 and toggle link 130. For example, the work done in such circumstances reduces from 4.49 Nmm to 1.65 Nmm with a seal force of 1000N.

The different system unlatching work done is compared in Table 1.

TABLE 1

| Comparison of work done | | |
|---|---|---|
| Claw load (N) | Toggle with sec. Pawl (Nmm) | Toggle with roller sec. Pawl (Nmm) |
| 10000 | 44.16 | 14.59 |
| 1000 | 4.49 | 1.65 |

A method for releasing a primary pawl from a claw where the primary pawl applying a engaging force to the claw includes attaching the primary pawl to a toggle link, holding the toggle link in place with a secondary pawl, and applying a releasing force to secondary pawl. Applying a releasing force to secondary pawl releases the toggle link and the pawl engaging the claw. The releasing force is less than the engaging force between the pawl and the claw.

A method of releasing a door latching mechanism includes holding onto a high force object, and releasing the high force object with a lesser force. Holding onto a high force object includes holding onto the high force object with a toggle link. The method also includes substantially immobilizing the toggle link with a force less than the high force. The method also includes releasing the toggle link with the lesser force.

The release force associated with a latch mechanism is affected by contamination such as dust ingress at the interface between the primary pawl and the claw. In the presence of contaminates, unlatching efforts double. Generally, the unlatching efforts reduce after initial contamination. However, the work necessary to release the latching mechanism generally does not return to original values associated with the latch before contamination. Considering the latching mechanisms that employ a toggle link 130, increased friction between the primary pawl 140 and claw 120 is not as relevant as the primary pawl 140 is not being pulled out of engagement with the claw 120 to unlatch. Increased friction between the primary pawl 140 and the toggle link 130 and their pivot points 144, 134 will actually reduce the necessary unlatching force since a lower load will be applied to the secondary pawl 160. The secondary pawl 160, however, remains sensitive to contamination, such as dust ingress and specifically to contamination at the interface between the secondary pawl 160 and the toggle link 130.

Figure 10:
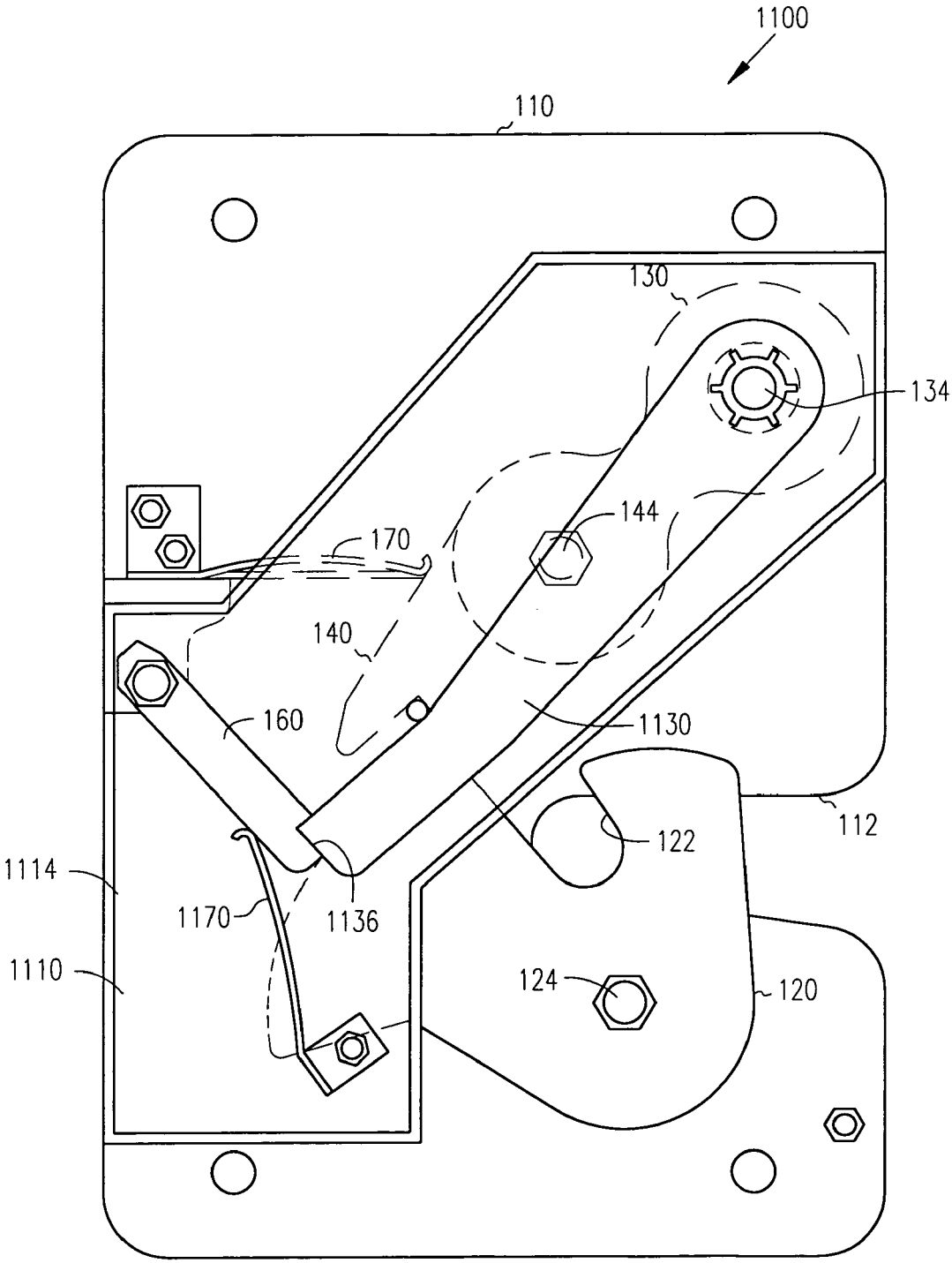
FIG. 10 shows a latch mechanism according to an embodiment of this invention.

FIG. 10 shows a latch mechanism 1100 according to an embodiment of this invention. In the latch mechanism 1100 includes an enclosure 1110 that encloses at least a portion of the toggle link 130. The enclosure 1110 provides a protected area that is free or substantially free of contaminant. The portion of the toggle link 130 that is placed within the enclosure 1110 is the contact point between the secondary pawl 160 and the arm 1130 of the toggle link 130. The pivot point 134 of the toggle link 130 is extended with a shaft 1134. The shaft 1134 extends through to the enclosure 1110. The shaft 1134 can be substantially sealed with a seal 99 at the position where it passes through the enclosure 1110. Therefore, the enclosure 1110 prevents contamination of the interface between the arm 1130 of the toggle link 130 and the secondary pawl 160.

An arm 1130 is attached to the shaft 1134. The secondary pawl 160 engages a portion of the arm 1130 and maintains the offset distance at the toggle joint 144. As shown in FIG. 10, the secondary pawl 160 engages free end 1136 of the arm 1130. A spring 1170 inside the enclosure 1110 biases the secondary pawl 160 in a position where it engages arm 1130. Applying a significant amount of contaminants will not get to the interface between the secondary pawl 160 and the free end of the arm 1130, thereby assuring low force release of the latching mechanism.

Figure 11:
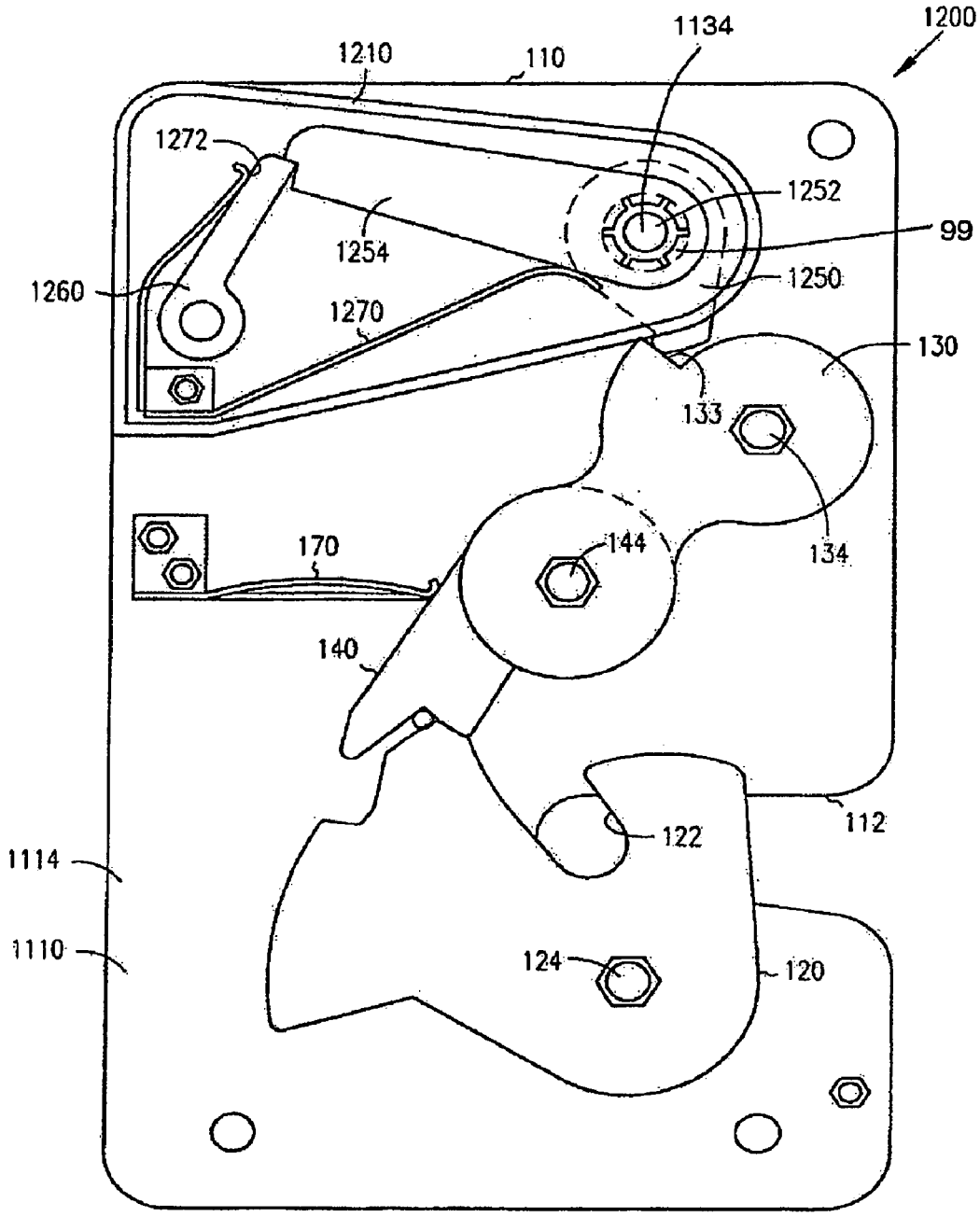
FIG. 11 shows a latch mechanism according to an embodiment of this invention.
Figure 12:
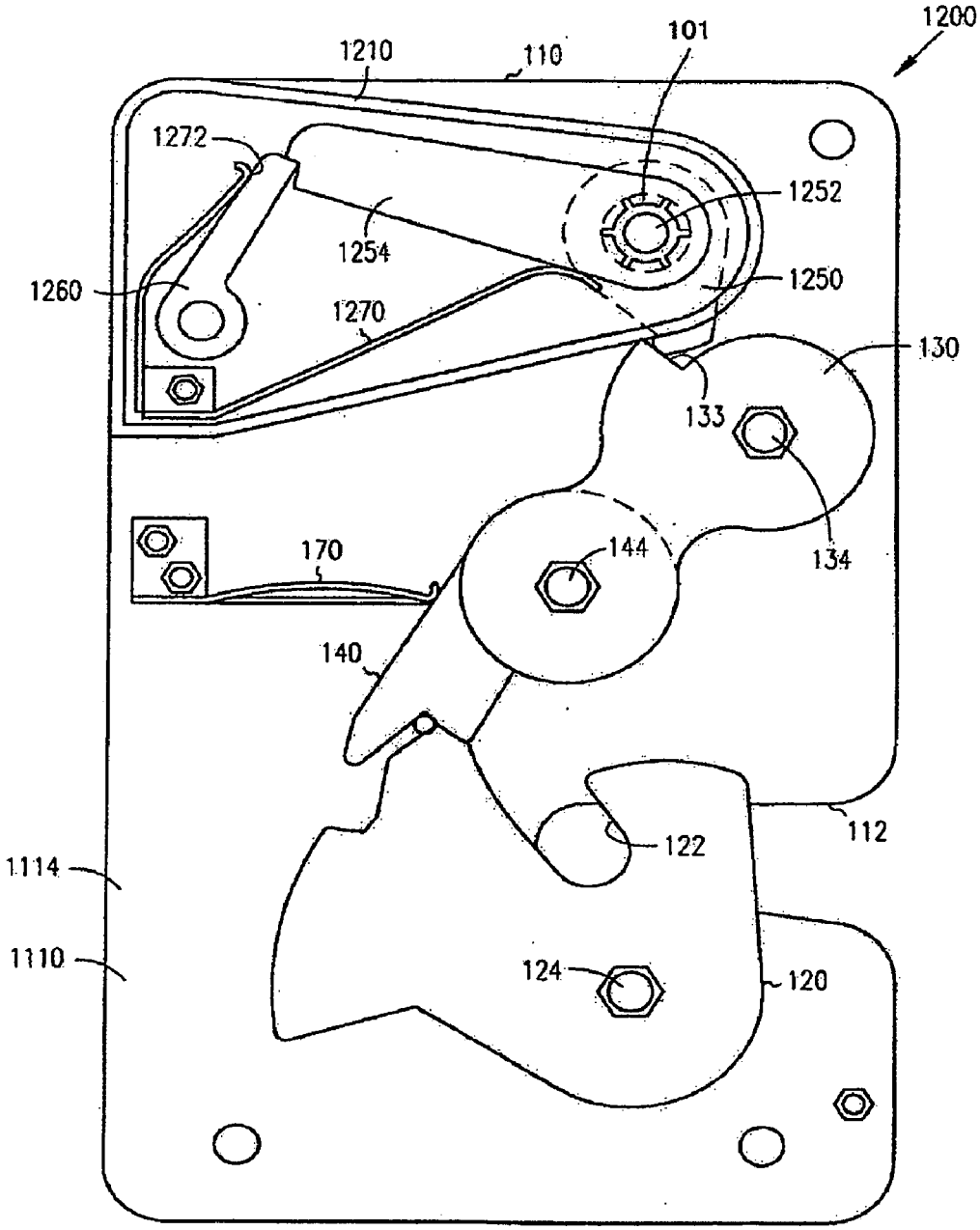
FIG. 12 shows a chart that plots a relationship for a toggle having equal length

FIG. 11 shows a latch mechanism 1200 according to an embodiment of this invention. A first lever 1250 is driven by the toggle link 130. The toggle link includes a first lever engagement surface 133. The latch mechanism 1200 includes an enclosure 1210 that encloses a second lever 1254 that is within the enclosures 1210. Attached to the first lever 1250 is a shaft or similar rotary connection 1252 that passes from the first lever outside the enclosure 1210 to the second lever 1254 within the enclosed area 1210. The connection 1252 is sealed with a seal 101. A gasket is used to seal the area between the shaft or similar rotary connection and the enclosure 1210. The second lever 1254 is attached to the shaft or similar rotary connection 1252. A secondary pawl 1260 is also within the enclosed area 1210. The secondary pawl 1260 engages the second lever 1254. A spring or biasing element 1270 is also within the enclosed area 1210. The biasing element has a portion 1272 that engages the secondary pawl 1272 and maintains the secondary pawl 1272 in the engaged position with the second lever 1254. The biasing element 1270 also has a portion 1274 that engages the second lever 1254 to prevent the second lever 1254 from falling to a position where the secondary pawl 1260 will not engage the second lever 1254. Releasing the secondary pawl 1260 form the second lever 1254 allows the toggle link 130 to rotate to about pivot pint 134. The offset distance at the pivot point 144 increases thereby releasing the pawl 140 from the claw 120. The enclosure 1210 provides a protected area that is free or substantially free of contaminants. The second lever 1254 of latch mechanism 1200, the secondary pawl 1260 and the biasing element 1270 are placed within the enclosure 1210 to keep the interface between the second pawl 1260 and the second lever 1254 relatively free of contaminants. Since the interface between the second pawl 1260 and the second lever 1254 is kept relatively free of contaminants, the release force does not increase due to the build up of contaminants.

A latch mechanism includes a latch plate associated with a first object, and a claw rotatably attached to the latch plate. A toggle link is rotatably attached to the latch plate. A primary pawl 140 is rotatably attached to the toggle link 130. The primary pawl retains the claw. A secondary pawl is rotatably attached to the latch plate. The secondary pawl retains the toggle link. The latch mechanism also includes an enclosure for enclosing at least a portion of the secondary pawl and at least a portion the latch mechanism engaging the secondary pawl. The enclosure inhibits contaminants from entering the enclosure. The enclosure has an opening therein. The enclosure further includes a seal such as a grommet or a gasket.

The latch mechanism also includes a primary biasing element that applies a biasing force to the primary pawl. The latch mechanism further includes a fixed pin attached to the latch plate. A surface of the primary pawl rides on the fixed pin. The latch mechanism also includes a secondary biasing element that applies a biasing force to the secondary pawl. The latch mechanism further includes a stop positioned to limit the motion of the claw with respect to the toggle link. The pivot point of the primary pawl is offset from a line between the pivot point of the toggle link and the point on the toggle link where the secondary pawl engages the toggle link. The claw further includes a first surface for engaging the primary pawl, and a second surface for engaging the primary pawl.

A method for controlling the release force of a latch mechanism includes holding a portion of the latch mechanism in place with a pawl, and controlling ingress of contaminates at an interface between the pawl and a portion of the latch mechanism. Controlling ingress of contaminates includes enclosing a portion of the latch mechanism and a portion of the pawl to inhibit contamination at an interface between the pawl and a portion of the latch mechanism. In one embodiment, enclosing a portion of the latch mechanism and a portion of the pawl to inhibit contamination at an interface between the pawl and a portion of the latch mechanism includes enclosing the entire pawl. In one embodiment, the pawl having an enclosed portion that interacts with a portion of the latching mechanism other than a claw. In some embodiments, enclosing a portion of the pawl and a portion of the latching mechanism includes substantially sealing an opening through which a portion of the pawl or a portion of the locking mechanism extends.

A latch mechanism includes a latch plate, a latching element attached to the latch plate, and a pawl engaging the first latching element at an interface. Applying a force to the pawl releases the latch mechanism. The latch mechanism also includes an enclosure for enclosing the interface between the pawl and the latching element.

In the foregoing Description of Embodiments of the Invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Description of Embodiments of the Invention, with each claim standing on its own as a separate preferred embodiment.

The invention claimed is:

1. A latch mechanism comprising:

a latch plate associated with a first object;

a claw rotatably attached to the latch plate;

a toggle link rotatably attached to the latch plate;

a primary pawl rotatably attached to the toggle link, wherein the primary pawl is for retaining the claw, and a primary pawl pivot point of the primary pawl is offset from a toggle link pivot point of the toggle link;

a secondary pawl rotatably attached to the latch plate, wherein the secondary pawl is for retaining the toggle link; and an enclosure for enclosing at least a portion of the latch mechanism and including at least a portion of the secondary pawl.

2. The latch mechanism of claim 1 wherein a toggle link portion of the toggle link and a secondary pawl portion of the secondary pawl contact each other at an interface, and the interface is located within the enclosure.

3. The latch mechanism of claim 1 wherein the secondary pawl is located within the enclosure.

4. The latch mechanism of claim 1 wherein the enclosure inhibits contaminants from entering the enclosure.

5. The latch mechanism of claim 1 wherein the enclosure has an opening therein, the latch mechanism including a driveable connection extending through the opening in the enclosure and to a lever outside the enclosure.

6. The latch mechanism of claim 1 wherein the enclosure has an opening, the latch mechanism including a driveable connection extending through the opening and linked to the secondary pawl, the enclosure further including a seal between the drivable connection and the opening in the enclosure.

7. The latch mechanism of claim 6 wherein the seal is a grommet.

8. The latch mechanism of claim 6 wherein the seal is a gasket.

9. The latch mechanism of claim 1 further comprising a primary biasing element for applying a biasing force to the primary pawl.

10. The latch mechanism of claim 9 further comprising a fixed pin attached to the latch plate, wherein a surface of the primary pawl rides on the fixed pin.

11. The latch mechanism of claim 9 comprising a secondary biasing element for applying a biasing force to the secondary pawl, wherein at least a portion of the secondary biasing element is located within the enclosure.

12. The latch mechanism of claim 1 further comprising a stop positioned to limit motion of the primary pawl with respect to the toggle link.

13. The latch mechanism of claim 1 wherein the claw further includes a first surface for engaging the primary pawl and determining a primary latched position and a second surface for engaging the primary pawl and determining a secondary latched position.

14. The latch mechanism of claim 1 wherein the primary pawl pivot point moves relative to the latch plate.

15. A latch mechanism comprising:

a latch plate associated with a first object;

a claw rotatably attached to the latch plate;

a toggle link rotatablv attached to the latch plate;

a primary pawl rotatablv attached to the toggle link, wherein the primary pawl is for retaining the claw, and primary pawl pivot point of the primary pawl is offset from a line between an engagement point between the primary pawl and the claw and a toggle link pivot point of the toggle link to the latch plate;

a secondary pawl rotatably attached to the latch plate, wherein the secondary pawl is for retaining the toggle link; and an enclosure for enclosing at least a portion of the latch mechanism and including at least a portion of the secondary pawl.

* * * * *

UNITED STATES PATENT AND TRADEMARK OFFICE

CERTIFICATE OF CORRECTION

PATENT NO. : 7,413,225 B2
APPLICATION NO. : 10/914431
DATED : August 19, 2008
INVENTOR(S) : Spurr It is certified that error appears in the above-identified patent and that said Letters Patent is hereby corrected as shown below:

Claim 11, Column 10, line 23: Insert --further-- before "comprising"

Claim 15, Column 10, line 10: "rotatablv" should read as --rotatably--

Claim 15, Column 10, line 40: "rotatablv" should read as --rotatably--

Claim 15, Column 10, line 42: Insert --a-- after "and"

Signed and Sealed this

Eleventh Day of November, 2008

JON W. DUDAS
*Director of the United States Patent and Trademark Office*